US005236063A

United States Patent [19]

Nelson et al.

[11] Patent Number: 5,236,063

[45] Date of Patent: Aug. 17, 1993

[54] RAIL LUBRICATING DEVICE

[75] Inventors: Roy Nelson, Lakeville; Robert Pieper, Minnetonka, both of Minn.

[73] Assignee: Robolube Industries, Inc., Minneapolis, Minn.

[21] Appl. No.: 843,000

[22] Filed: Feb. 28, 1992

[51] Int. Cl.[5] ..... B61K 3/00

[52] U.S. Cl. ..... 184/3.2; 184/29; 184/104.1; 104/279

[58] Field of Search ..... 184/3.1, 3.2, 6.24, 184/2, 29, 104.1; 417/390; 104/279; 198/500

[56] References Cited

U.S. PATENT DOCUMENTS

| | | | |
|---|---|---|---|
| 1,510,721 | 10/1924 | Tieck | 184/3.2 |
| 2,428,035 | 9/1947 | Palm | 184/29 |
| 2,586,256 | 2/1952 | Quarles | 184/3.2 |
| 2,602,694 | 7/1952 | Richardson | 184/3.2 |
| 3,542,153 | 11/1970 | Phillips | 184/3.1 |
| 3,937,596 | 2/1976 | Braidwood | 417/390 |
| 4,520,902 | 6/1985 | Snow | 184/29 |
| 4,569,480 | 2/1986 | Levey | 417/390 |
| 4,711,320 | 12/1987 | Dombroski et al. | 184/3.2 |
| 4,736,818 | 4/1988 | Wolfe | 184/3.2 |
| 4,930,600 | 6/1990 | Kumar | 184/3.2 |

FOREIGN PATENT DOCUMENTS 3214149 11/1983 Fed. Rep. of Germany ..... 104/279

*Primary Examiner*—Albert J. Makay
*Assistant Examiner*—Alan B. Cariaso
*Attorney, Agent, or Firm*—James R. Cwayna

[57] ABSTRACT

A mobile unit positionable and drivable upon railroad tracks for applying a bead of lubricant to the gauge surfaces of the track which includes a lubricant delivery source for delivering lubricant to a pair of nozzles which are arranged in position to direct the lubricant onto the proper area of the track. The unit includes an electric/hydraulic power unit to supply pumping power to a primary lubricant delivery unit which directs the lubricant through a common flow system to the nozzles which are directed to the proper rail locations. The unit also includes lubricant filters, automatic shut off devices and automatic speed control devices for proper delivery of the lubricant to the rail surface. Heating devices are included for temperature maintenance of the lubricant under various temperature conditions.

8 Claims, 3 Drawing Sheets

FIG. 3
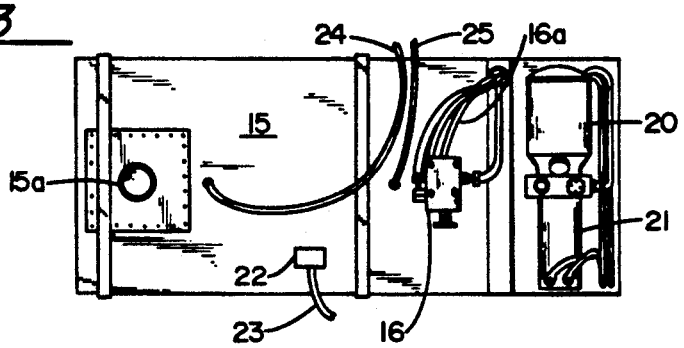
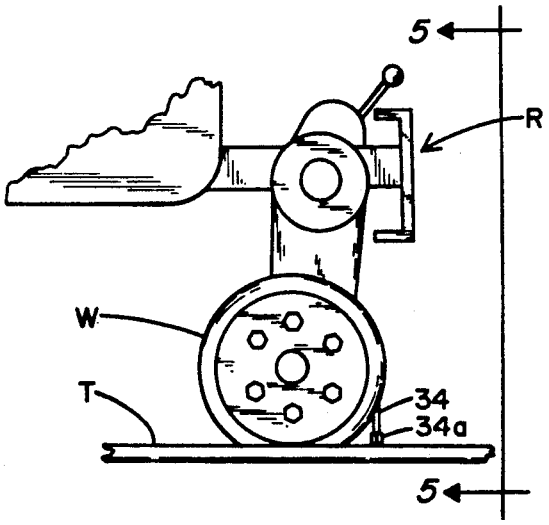
FIG. 4
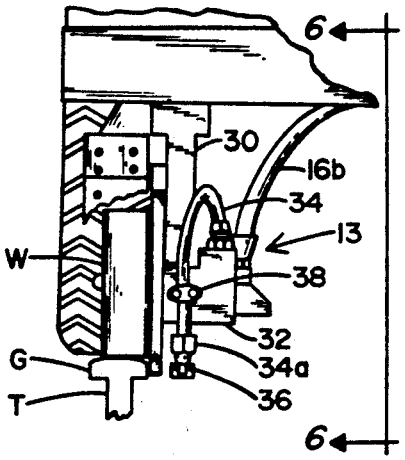
FIG. 5
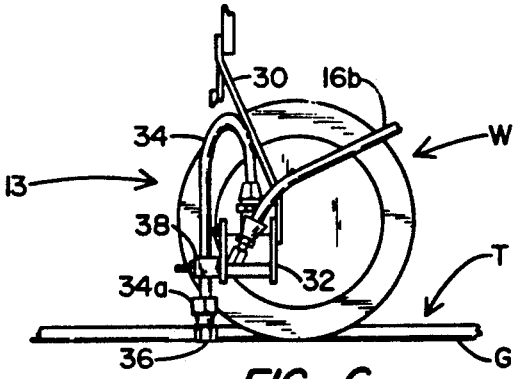
FIG. 6

RAIL LUBRICATING DEVICE

RELATED APPLICATIONS

There are no applications currently on file in the United States Patent Office related to this application.

FEDERAL SPONSORSHIP

This invention is not made under any Federally sponsored research or development arrangement nor under any other independently sponsored research and development arrangement.

SUMMARY OF THE INVENTION

A mobile unit positionable and driveable upon railroad tracks for application of a lubricant to the gauge flange of the track.

A pair of lubricant applicating nozzles are provided to direct lubricant to the internal gauge flange of the tracks as the mobile unit is driven along the tracks. Control mechanisms are provided to control the lubricant application in accordance with the speed of movement of the carrying vehicle. The unit also includes heaters for heating the lubricant for proper application under cold conditions.

The system for dispensing the lubricant includes a supply tank from which the lubricant is dispensed through an electric/hydraulic pump driving a primary delivery pump. The application system includes lubricant filters and flow and shut-off mechanisms and pressure relief mechanisms allow for complete control of the lubricant distribution flow lines.

BACKGROUND OF THE INVENTION

As stated in the accompanying prior art statement the concept of lubricating the internal gauge flanges of railroad tracks to substantially reduce friction developed is well known in the art. The particular importance arises when trains are passing along curved portions of the track. Other prior art situations have been developed for lubrication of track joints and switch areas and the concepts of this invention are equally applicable to such uses.

Application of a lubricant to the gauge surfaces of railroad tracks also significantly reduces wear along the flanged wheel of the train and significantly reduces wear upon the track gauge surface.

With the device as disclosed herein means are provided for positively controlling the amount of lubricant to the gauge surfaces of the track. The amount of lubricant is controllable during movement and delivery of the lubricant is stopped at controllable low speeds of the carrying vehicle or when the carrying vehicle is not moving.

It is therefore an object of the applicants' invention to provide a rail lubricating device for controlled application of lubricant to the gauge surfaces of railroad tracks.

It is a further object of the applicants' invention to provide a mobile railroad track lubricating device which allows for determined delivery of the lubricant for proper track maintenance and friction wear elimination to the flanged surfaces of wheels of a train.

It is still a further object of the applicants' invention to provide a rail lubricating device which includes speed related delivery control of lubricant to the gauge flanges of railroad tracks with means for speed related control of the lubrication for proper delivery of a bead of lubricant to the rail flange.

It is still a further object of the applicants' invention to provide a rail lubricating device which includes means for heating the lubricant to be delivered to insure proper delivery thereof under cold weather conditions.

These and other objects and advantages of the applicants' invention will more fully appear from a consideration of the enclosed drawings and description of the device.

DESCRIPTION OF THE DRAWINGS

FIG. 3 is a section substantially along Line 3—3 of FIG. 1 illustrating operative components of applicants' lubricant delivery portion of the invention;

FIG. 4 is a side elevation of the track gear guiding assembly and illustrating applicants' lubricant nozzle placement relative thereto;

FIG. 5 is a vertical section taken substantially along Line 5—5 of FIG. 4;

FIG. 6 is a vertical section taken substantially along Line 6—6 of FIG. 5;

DESCRIPTION OF A PREFERRED FORM OF THE INVENTION

Figure 1:
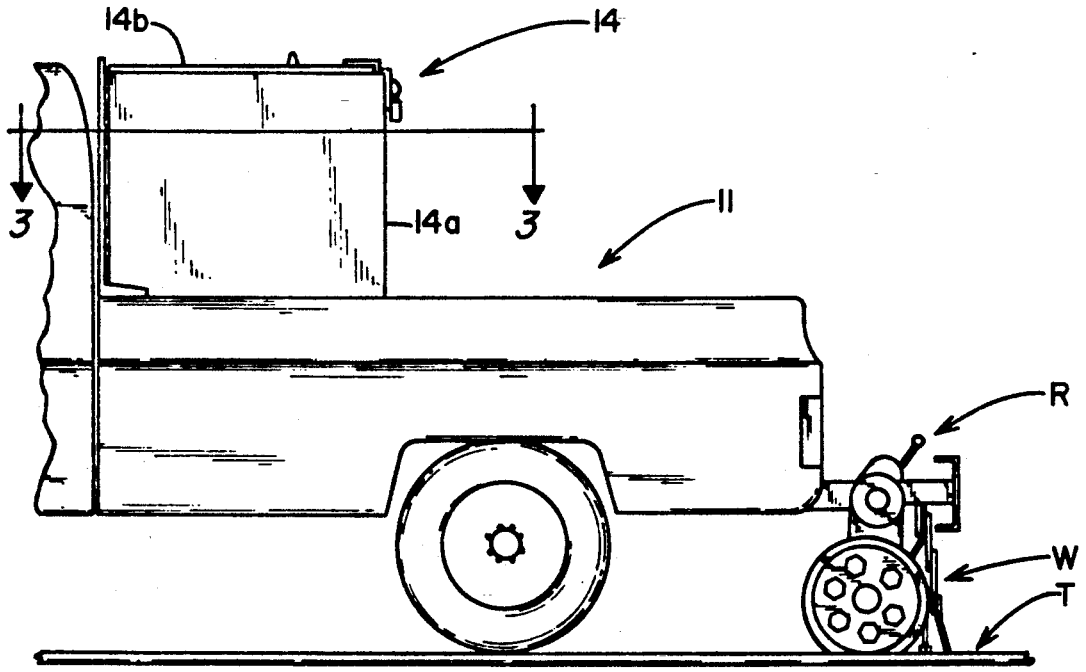
FIG. 1 is a partial side elevation of the rear portion of a conveying vehicle commonly used for track maintenance particularly illustrating the track gear and the article of the invention mounted thereon.
Figure 2:
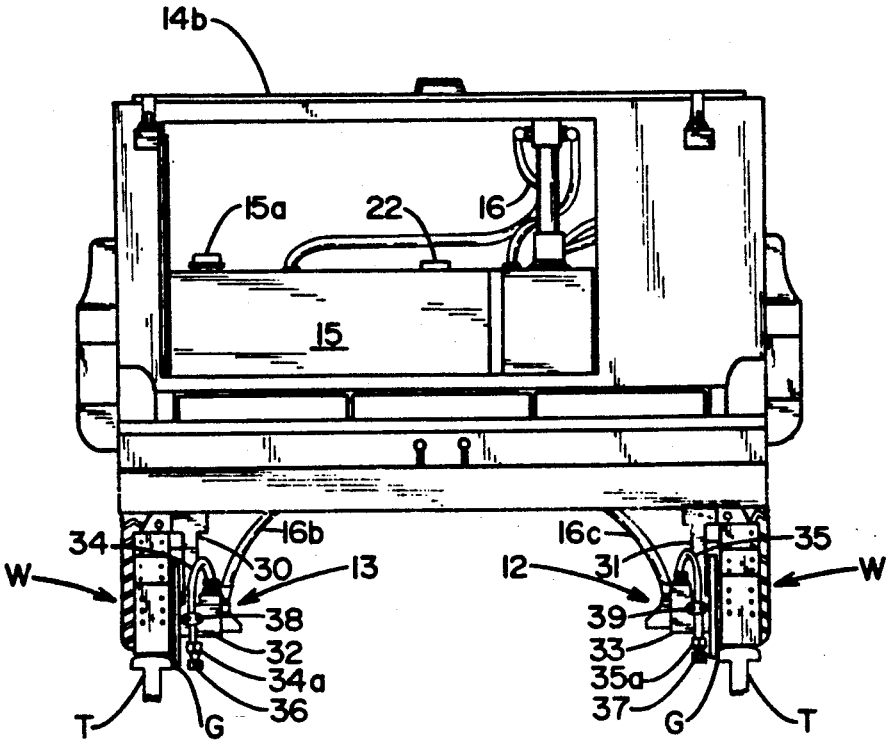
FIG. 2 is a rear elevation of the unit illustrated in FIG. 1.

In accordance with the accompanying drawings applicant provides a carrier vehicle 11 which will carry the entire pumping mechanism and lubricant storage area designated 10 for driving and movement along a railroad track T. In order to properly move the vehicle 11 along the track T rail gear R is provided for both the front (not illustrated) of the vehicle 11 and the rear of the vehicle 11. Such rail guiding gear is commonly known to the art and such gear R allows the four wheels of the vehicle 11 to maintain contact with the track T with the drive wheels of the vehicle 11 providing drive power thereto. The rail gear R is shiftable from normal track guiding and engaging position to an off-rail position which allows the carrying vehicle 11 to then be used as an ordinary on-road vehicle. Rail gear R includes flanged wheels W for proper guiding of the carrier vehicle 11 along the track.

Portions of the track T which are to be lubricated are limited to the inner gauge surfaces or inner gauge flanges G of the track. It is along this surface G that damaging friction occurs not only to the track but to the standard flanged wheels of the train. By applying lubricant to surface G particularly when the train is being driven through a curved track section the lubricant reduces the friction and such friction reduction obviously reduces track and wheel damage and the power required to move the train.

The primary aspects of the applicants' unit consist in the working mechanism for storage and delivery of the lubricant and the nozzle sections 12, 13 which direct the lubricant to the gauge G surfaces. The working, storage and delivery components are contained within an insulated housing 14 carried by the vehicle 11. This insulated housing 14 obviously provides a bottom, upstanding sides and a top and normally will provide an access panel 14*a* and a hinged top 14*b* for access to the inner working components.

In accordance with, particularly FIG. 3 a lubricant storage tank 15 is provided having filler access 15*a* on one end thereof and a primary lubricant pumping mechanism 16 on the opposite end thereof. Position of such elements is a matter of choice.

Figure 7:
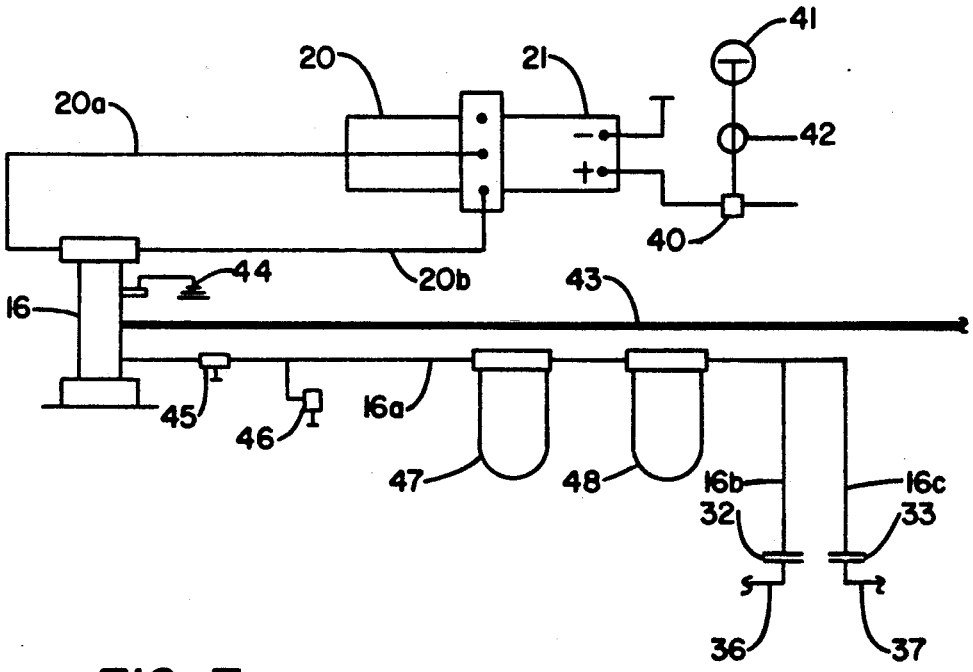
FIG. 7 is a diagrammatic illustration of the lubricant flow lines of the system; and, FIG. 8 is a schematic electrical and system diagram particularly illustrating various control and operative portions of the unit.

As illustrated, a hydraulic pump 20 and electrical drive motor arrangement 21 is provided to generate hydraulic pressure fluid flow directly to pump 16. The aspect of such an arrangement is that the electric motor is operated from the electrical generating system of the carrying vehicle and through proper design sufficient hydraulic pressure is created for driving pump 16 to pump the quantity of lubricant desired. Other systems have utilized the electrical power from the vehicle to directly drive the lubricant pump and very often the electrical system of the carrier vehicle is insufficient for proper operation thereof. Obviously hydraulic lines must be provided between pump 20 and lubricant pump 16 and obviously fluid lines must be provided from the pump 16 to the respective nozzle sections 12,13. All of these connective lines are best illustrated in the view of FIG. 7 which will be discussed hereinafter.

Applicant also provides two heating systems for the lubricant held within the tank 15. In a first form this heater simply designated 22 with connective lines 23 extending therefrom. This particular heater 22 is an electric powered submersible heater which will be energized from, for example, a 120 volt remote source and is used for maintaining the temperature of the lubricant within the tank 15 at a proper level during periods when the vehicle is not in operation. For example, when the vehicle is parked outside in cold weather or even relatively cool weather the viscosity of the contained lubricant would increase and not allow for immediate operation of the unit. By providing an electrical submersible heater connected to a remote source the lubricant is maintained at a temperature that would allow an immediate start up operation of the unit. Obviously when operating in cool or cold conditions it is necessary to maintain the lubricant in proper pumping condition and for this reason heater lines 24, 25 are provided for attachment to the heater system of the carrying vehicle. A submersible heater is provided along these lines interiorly of the container 15 to maintain the lubricant in pumpable state. A dual heating system which is operable in both non-vehicle operating conditions and vehicle operating conditions is provided.

In addition to all of the elements illustrated within the enclosure 14 an additional electric heater (not shown) driven by the vehicle electric system is provided interiorly of the cabinet 14 to maintain the heat within the container 14 while the vehicle travels.

The nozzle units 12,13 are respectively arranged adjacent to the wheels W of the rail gear R to direct lubricant to the gauge surface G of the track T and delivery line 16*a* is divided to provide separate, parallel nozzle feed lines 16*a*, 16*b*. Obviously then as illustrated in FIG. 6 each nozzle unit is positioned slightly behind the flange of the wheel.

A primary mounting bar 30, 31 is provided for attachment of the nozzle sections 13, 14 to the rail gear R and this bar 30, 31 extends downwardly to a line and nozzle connecting block 32, 33 which receive lubricant from lines 16*b*, 16*c*. Extending from the blocks 32, 33 are nozzle lines 34, 35 which extend to the lubricant applicating nozzles 36, 37. A universal connector 34*a*, 35*a* is provided in lines 34, 35 and the nozzles 36, 37 to permit rotation of the nozzles for properly aiming the lubricant. A mounting block and locking arrangement 38, 39 is also provided to maintain the elevation of the nozzles 36, 37 with respect to the gauge surface G.

Obviously this entire nozzle arrangement 12, 13 is shiftable along with and upon movement of the rail gear R and is in rail lubricating position only when the rail gear R is in its lowered position.

Figure 8:
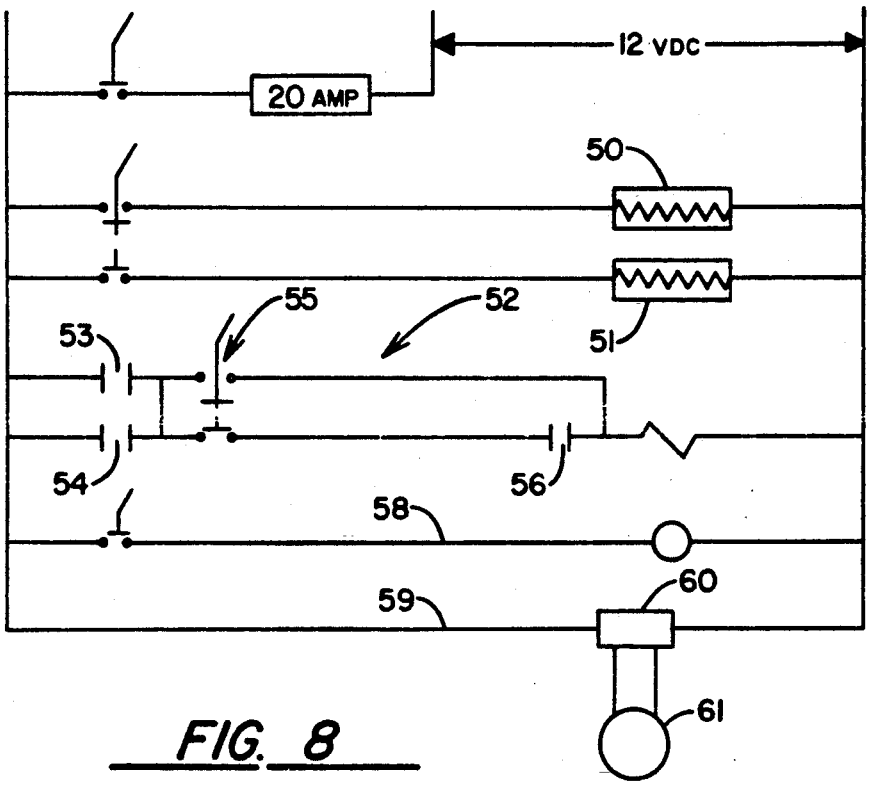

The operational schematics are illustrated in FIG. 7 and FIG. 8. The hydraulic system is particularly illustrated in FIG. 7 while the diagram of FIG. 8 relates primarily to electrical and monitoring control for lubricant delivery.

As illustrated in FIG. 7 the electric motor is designated 21, the driven hydraulic pump being designated 20. Electrical power is delivered to the motor 21 through appropriate leads from the vehicle electrical system which normally is a 12 volt DC source. Solenoid 40 is provided in the positive DC line and this solenoid is controlled by a manual operation switch 41 within the vehicle cab. A speed monitoring switch 42 is also provided to control solenoid 40 and provides a speed override which will trip the solenoid at low speed to cause cessation of lubricant delivery. Fluid flow lines from pump 20 are designated 20*a*, 20*b* to provide a pumping circuit to drive the lubricant pump 16. Pump 16 intake extends into the lubricant within the container 15 to deliver the same through line 16*a*. A drain line 43 is provided for draining the pumping cylinder of pump 16 and a grounding circuit 44 is provided for grounding of the pump 16. The lubricant flow line 16*a* includes a shut off line restrictor 45 for controlling the amount of lubricant delivered from the pump 16 through line 16*a*. This restrictor 45 may be remotely controlled from the vehicle cab and may be automatically speed responsive. In addition to this shut off line restrictor 45 a shut off/pressure relief 46 is provided to allow complete drainage of the nozzle system and to allow pressure relief from the pump 16. Also, within line 16*a* are a pair of lubricant filters 47, 48 which provide positive filtering of the lubricant prior to passing through the nozzles 36, 37. The manifold or line connector blocks 32, 33 are illustrated in the now split delivery lines 16*b*, 16*c*.

Obviously the entire hydraulic system then includes manual control operation from the cab by the operator, a speed control function for stopping the lubricant delivery system at low speeds and mechanisms for pressure relief and filtering of the unit. The speed control system is of particular interest in that should the carrier vehicle slow to a predetermined point, all lubricant delivery will be stopped to prevent waste of lubricant and also to prevent excessive distribution of lubricant to the rail at low speeds.

The schematic illustration of FIG. 8 particularly sets forth various electrical controls for the arrangement. The initial supply consists of the 12 volt DC from the carrier vehicle with a 20 amp control fuse block. Both a high heater 50 and a low heater 51 arrangement are provided for the electrical submersible heater 22. The section designated 52 includes a speed meter section 53, a test relay section 54, control switches 55 for the same and a distance meter 56. The distance meter controls the solenoid 40 through a pulse counting arrangement. Section 58 simply provides a test relay arrangement and section 59 refers to the speed/distance meter which includes the pulse generator 60, 61 associated with the distance meter or pulse counter 56. Block 60 designates a speed/distance meter while element 61 represents the pulse generator. Primarily FIG. 8 represents the controls available to the operator.

Applicants' device then provides a unique device and apparatus for proper lubrication of gauge flanges of railroad tracks. It includes a unique pumping system with complete control of the lubricant being pumped in that it is both speed responsive and distance monitorable with the operator being able to set the amount of lubricant for the operative speeds at which the carrier vehicle is moving. Such control prevents waste of lubricant from over lubrication or by the pumping of lubricant when the unit reaches a particularly slow speed or is stopped. The applicants' nozzles also provide for directive application of the lubricant and by proper aiming of the same proper lubricant application is controlled at any speed. The entire system then provides for proper rail lubrication and insures against waste of lubricant.

What is claimed is:

1. A track lubricating device in combination with a carrying vehicle which vehicle is provided with a shiftable track guide wheeled unit which permit the vehicle to travel along a track having an inner gauge surface and to travel off the track, the lubricating device including:

a. a single container providing a source of lubricant supply carried by the vehicle;

b. a pair of nozzles arranged respectively in close association to the wheels of the track guide unit for movement with the track guide unit and directed respectively at the inner gauge surfaces of the track for application of lubricant to said gauge surfaces;

c. lubricant pump means having an intake communicating with the lubricant supply and having a discharge;

d. said discharge communicating with said nozzles for the delivery of lubricant thereto;

e. means for driving said lubricant pump including:

1. a hydraulic pump fluidly connected to said lubricant pump;

2. an electric motor connected to said hydraulic pump; and, 3. means for supplying electrical power to said electric motor.

2. The track lubricating device as set forth in claim 1 wherein the carrying vehicle is provided with a fluid heating and fluid transfer means and said fluid transfer means provides at least a portion thereof extending to and positionable within the lubricant supply container for heating of the lubricant therein.

3. The track lubricating device as set forth in claim 1 and means for monitoring the speed of the carrying vehicle and controlling the delivery of lubricant from said lubricant pump to terminate lubricant delivery when the vehicle is travelling at a predetermined low speed.

4. The track lubricating device as set forth in claim 1 and means for monitoring the speed of the carrying vehicle and controlling the delivery of lubricant from said lubricant pump to terminate lubricant delivery when the vehicle is not moving.

5. The track lubricating device as set forth in claim 1 and at least a pair of filter means arranged to filter the lubricant delivered from said lubricant pump prior to delivery to said nozzles.

6. The track lubricating device as set forth in claim 1 and said pair of nozzles being mounted on said shiftable track guide unit for movement therewith when said guide unit is shifted from track contacting position to a position to allow the vehicle to travel off the track.

7. The track lubricating device as set forth in claim 1 and:

a. an insulated housing surrounding at least said lubricant supply container, said lubricant pump, said hydraulic pump and said electric motor;

b. electric heater means arranged within said insulated housing;

c. the carrying vehicle being provided with electrical power generating means; and, d. said generating means being electrically connected to said electric heater means.

8. The track lubricating device as set forth in claim 1 and:

a. an electrical heater being submersibly arranged in said single lubricant supply for heating of the lubricant; and, b. means for supplying electrical power to said submersed heater including means for connecting said heater to said vehicle electrical power generating means and alternatively to an external source of power remote the carrying vehicle.

* * * * *